US005599271A

United States Patent [19]

Eiken

[11] Patent Number: 5,599,271

[45] Date of Patent: Feb. 4, 1997

[54] METHOD OF REGULATING THE OUTLET FLOW OF A LIQUID SEPARATED IN A CENTRIFUGAL SEPARATOR AND A CENTRIFUGAL SEPARATOR TO CARRY OUT THE METHOD

[75] Inventor: Jon Eiken, Stockholm, Sweden

[73] Assignee: Alfa Laval Separation AB, Tumba, Sweden

[21] Appl. No.: 553,402

[22] PCT Filed: May 19, 1994

[86] PCT No.: PCT/SE94/00466

§ 371 Date: Feb. 20, 1995

§ 102(e) Date: Feb. 20, 1995

[87] PCT Pub. No.: WO94/27726

PCT Pub. Date: Dec. 8, 1994

[30] Foreign Application Priority Data

May 21, 1993 [SE] Sweden ..... 9301743

[51] Int. Cl.[6] ..... B04B 11/02

[52] U.S. Cl. ..... 494/37; 494/56; 494/70

[58] Field of Search ..... 494/2–4, 37, 56, 494/57, 68–73

[56] References Cited

U.S. PATENT DOCUMENTS

| | | | |
|---|---|---|---|
| 4,718,887 | 1/1988 | Gunn . | |
| 4,784,635 | 11/1988 | Bruning et al. | 494/70 |

FOREIGN PATENT DOCUMENTS

| | | | |
|---|---|---|---|
| 710185 | 5/1965 | Canada | 494/56 |
| 630308 | 5/1936 | Germany . | |
| 180619 | 9/1962 | Sweden . | |
| 156097 | 10/1932 | Switzerland . | |
| WOA18903250 | 4/1989 | WIPO . | |

*Primary Examiner*—Charles E. Cooley
*Attorney, Agent, or Firm*—Fish & Richardson P.C.

[57] ABSTRACT

Method in a centrifugal separator of regulating during operation the outlet flow through a stationary discharge device, which is arranged in an outlet chamber, of a separated liquid and a centrifugal separator to carry out the method. In order to accomplish a method and a centrifugal separator, which makes it possible to regulate the outflow of a liquid, which is separated in a centrifugal separator and discharged out of the same through a stationary discharge device within a wide flow range with small energy losses and with a small risk of rotor dynamical oscillations this outlet flow is regulated by bringing at least a portion of the separated liquid present in the outlet chamber (12) to rotate at a lower angular speed than the rotor in an angular zone (24) of the outer chamber, which is free from elements rotating with the rotor, and in which the inlet opening (19) is located, and by bringing liquid, which is present in this zone (24), to flow through at least one passage (26), which is delimited by elements (25) rotating with a rotor and which has an inlet (35) and an outlet (37) located outside this inlet (35) in the outlet chamber (12), when the free liquid surface is located radially inside a predetermined radial level (27), at which the inlet (35) of the passage is located.

9 Claims, 3 Drawing Sheets

METHOD OF REGULATING THE OUTLET FLOW OF A LIQUID SEPARATED IN A CENTRIFUGAL SEPARATOR AND A CENTRIFUGAL SEPARATOR TO CARRY OUT THE METHOD

FIELD OF THE INVENTION

The present invention concerns a method of regulating during operation the outlet flow of a liquid separated in a separation chamber in a rotor of a centrifugal separator, the rotor being rotatable around the rotational axis in a predetermined rotational direction, in which method the separated liquid is conducted into an outlet chamber and is brought to form a rotating liquid body in the outlet chamber with a radially inwardly directed free liquid surface and is discharged out of the outlet chamber through a stationary discharge device, which has at least one internal outlet channel with an inlet opening in a radially outer part of the discharge device, which during operation is located radially outside the free liquid surface.

Furthermore, the invention concerns a centrifugal separator, in which the outlet flow of a separated liquid is regulated according to this method. Such a centrifugal separator comprises a rotor, which is rotatable around a rotational axis in a predetermined direction and forms an inlet chamber for a liquid to be centrifugally treated, a separation chamber, which is connected to the inlet chamber, and an outlet chamber, which is delimited axially by two end walls and radially by a circumferential wall connecting these end walls and is arranged to receive during operation a liquid separated in the separation chamber, the outlet chamber being so designed that the liquid present in the same forms a rotating liquid body having a radially inwardly directed free liquid surface. The rotor also forms a connection, which is arranged through one of said end walls and has an opening in the outlet chamber located radially inside the radial level of the free liquid surface. The outlet chamber communicates through this connection with the separation chamber. The centrifugal separator also comprises a stationary discharge device, which is arranged in the outlet chamber and has at least one to an outlet connected outlet channel with an inlet opening in a part of the discharge device, which is located radially outside the free liquid surface.

BACKGROUND OF THE INVENTION

A centrifugal separator of this kind is shown in WO 89/03250. During operation of the shown centrifugal separator the liquid present in the outlet chamber is entrained gently into the rotation of the rotor by means of discs, which are arranged in the outlet chamber. The separated liquid is discharged out of the outlet chamber through a stationary discharge device arranged therein, which is connected to an outlet. The flow of the discharged liquid depends on the angular speed of the rotating liquid in the outlet chamber, the radial position of the free liquid surface, the design of the discharge device, and the prevailing counter pressure in the outlet for the liquid.

For every use of such a centrifugal separator a discharge device is chosen having for the actual case a suitable flow capacity range, which is limited for one and the same discharge device. Within the flow capacity range the flow is regulated by adjusting the counter-pressure in the outlet. If the actual flow of the separated liquid is low the counter-pressure from the equipment connected to the outlet often is insufficient and an extra counter-pressure has to be imposed at the outlet, which means energy losses. Besides, a low flow through the discharge device often results in an unstable flow, which in turn gives rise to rotor dynamical oscillations.

SUMMARY OF THE INVENTION

The object of the present invention is to accomplish a method and a centrifugal separator of the kind initially described, which makes it possible to regulate the outlet flow of the liquid, which is separated in a centrifugal separator and is discharged out of the same through a stationary discharge device within a wide flow range with small energy losses and with a small risk of rotor dynamical oscillations.

According to the present invention this is accomplished by the fact that the outlet flow discharged through the discharge device is regulated by bringing at least a portion of the separated liquid present in the outlet chamber to rotate at a lower angular speed than the rotor in an annular zone of the outlet chamber, which coaxially surrounds the rotational axis and is free from elements rotating with the rotor, and in which the inlet opening is located and by bringing the liquid present in this zone to flow through at least one passage, which is delimited by elements rotating with the rotor and has an inlet and a radially outside this inlet located outlet in the outlet chamber, when the free liquid surface is located radially inside a predetermined radial level, at which the inlet of the passage is located.

Hereby the separated liquid present in the outlet chamber is entrained effectively and the discharge capacity of the discharge device is increased at first when the free liquid surface is located radially inside the predetermined radial level and there is a need for an increased outlet flow.

In a preferred embodiment of the invention the separated liquid is conducted into the outlet chamber radially inside the free liquid surface and the liquid entered the outlet chamber is brought to flow radially outwardly towards the free liquid surface through channels along and in contact with the surface of a wall element, the surface delimiting the channel forwardly seen in the rotational direction and extending radially, axially and in the circumferential direction and being curved in a plane perpendicular to the rotational axis with a center of curvature, which at each point of the surface is located behind the surface seen in the rotational direction, and has a radius of curvature, which at essential each point of the surface is smaller than the radius of curvature of an involute, along which separated liquid freely strives to move radially outwardly relative to the rotor at the radius at which said point is located.

By bringing the separated liquid to rotate at a lower angular speed than the rotor in this manner at least a portion of the kinetic energy, which the separated liquid possesses when it enters the outlet chamber, is reused to operate the rotor.

A centrifugal separator of the kind initially described according to the present invention is designed with a discharge device, in which the inlet opening of the outlet channel is located in an annular zone of the outlet chamber, which surrounds the rotational axis and is so big and free from elements rotating with the rotor that liquid is admitted to rotate at an essential lower angular speed than the rotor. Furthermore, according to the invention a device is arranged in connection with the outlet chamber to bring at least a portion of the liquid which is present in this zone of the outlet chamber, during operation to rotate at a lower angular speed than the rotor, and elements rotating with the rotor are arranged to form at least one passage, which has an inlet located in the outlet chamber at a predetermined radial level radially inside the inlet opening of the outlet channel and an outlet located radially outside this radial level in a way such that the separated liquid is admitted to flow through this passage radially outwardly during entrainment of the same into the rotational rotor when said liquid surface is located radially inside the inlet of the passage.

In order to make recovery of the kinetic energy of the separated liquid at its entrance into the outlet chamber possible, said device comprises according to a preferred embodiment of the invention at least two wall elements, which are arranged in the outlet chamber fixedly connected to said one end wall and extend radially, axially and in the circumferential direction. The wall elements are arranged to between themselves form a channel for the flow of separated liquid which enters the outlet chamber via said connection, radially outwardly towards the free liquid surface. The channel is delimited forwardly seen in the rotational direction by a surface of the wall element, at least a part of the surface extending radially between the opening of the connection into the outlet chamber and the free liquid surface and is curved in a plane perpendicular to the rotation axis with a centre of curvature, which at essentially each point of this part of the surface is located behind the surface seen in the rotational direction, and with the radius of curvature, which at each point of this part of the surface is smaller than the radius of curvature of an involute, along which separated liquid strives to move freely radially outwardly relative to the rotor, at the same radius as the radius at which the point is located.

In another embodiment of the invention a covering device is arranged in the outlet chamber fixedly connected to each one of the wall elements on their axial ends turned from said one end wall and is arranged to at least delimit a portion of the channel located closest to the connection from the outlet chamber.

In a further embodiment of the invention said device for the energy recovery forms at least two passages having inlets, which each one is located at the predetermined radial level. The outlets of these two passages then can be located at the same or at different radial levels. In a special embodiment of the invention this device comprises at least one around the rotational axis extending angular disc, which has an opening extending radially outwardly towards the predetermined radial level. The opening in the disc is suitably circular and surrounding the rotational axis concentrically.

BRIEF DESCRIPTION OF THE DRAWINGS

In the following the invention will be described more closely with reference to the attached drawings, in which FIG. 1 schematically shows an axial section through a part of a centrifugal separator according to the invention, FIG. 2 schematically shows an axial section through a part of the centrifugal separator shown in FIG. 1 according to an embodiment of the invention, FIG. 3 schematically shows a radial section through a detail of the part shown in FIG. 2, and FIG. 4 schematically shows an axial section through a part of a centrifugal separator according to a modified embodiment of the invention.

DETAILED DESCRIPTION

Figure 1:
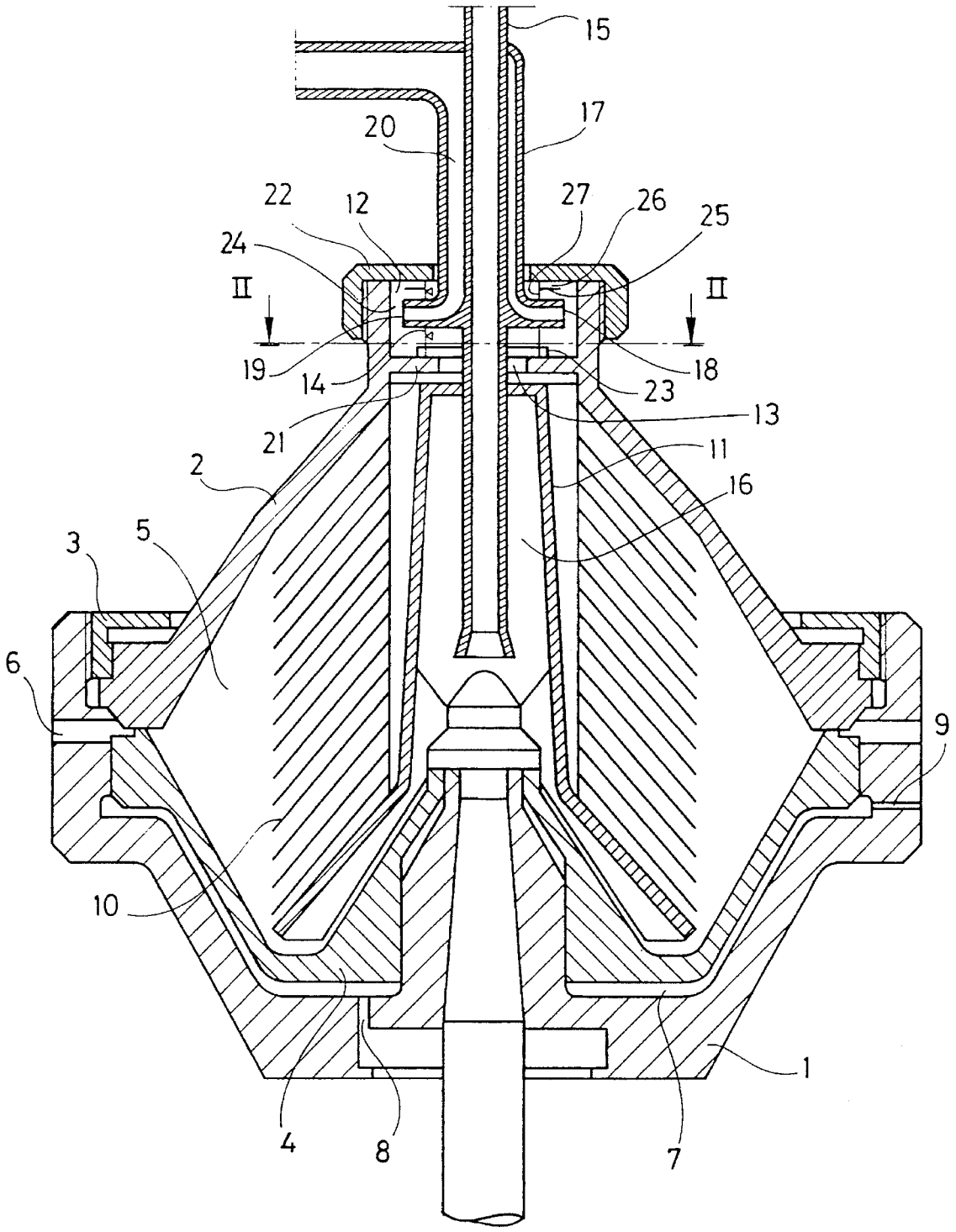

The part of a centrifugal separator according to the invention shown in FIG. 1 comprises a rotor, which has a lower part 1 and an upper part 2 which are joined together axially by means of a locking ring 3. Inside the centrifugal separator shown as an example there is arranged an axially movable valve slide 4. This valve slide 4 delimits together with the upper part 2 a separation chamber 5 and is arranged to open and close an annular gap towards peripheral outlet openings 6 for a substance, which during operation has been separated in the rotor and accumulated at the periphery of the separation chamber 5. The valve slide 4 delimits together with the lower part 1 a closing chamber 7, which is provided with an inlet 8 and a throttled outlet 9 for a closing liquid.

Inside the separation chamber 5 a disc stack 10 is arranged consisting of a number of conical separation discs between a distributor 11 and the upper part 2. The upper part 2 forms at its in the figure shown upper end an outlet chamber 12, into which in this case a relatively light, separated liquid can flow from the separation chamber 5 via a central passage 13. The liquid present in the outlet chamber 12 during operation of the rotor forms a rotating liquid body having a radially inwardly free liquid surface 14.

Centrally through the outlet chamber 12 a stationary inlet tube 15 extends, which opens into an inlet chamber 16 in the interior of the distributor 11. Next to the inlet tube 15 a stationary outlet tube 17 is arranged for the specific lighter liquid in the chamber 12. An outlet device 18 is arranged in the chamber around the inlet tube 15 and connected to the outlet tube 17.

The outlet device 18 extends radially outwardly in the outlet chamber 12 and has a portion located outside the radial level of the free liquid surface 14. In the outlet device 18 at least one outlet channel 20 is arranged with an inlet opening 19 which is located in this portion of the discharge device. The outlet channel 20 is connected to the interior of the inlet tube 17.

The outlet chamber is axially delimited by two end walls 21 and 22, the one 21 of which delimits the outlet chamber towards the separation chamber 5. The connection 13 is arranged centrally through this end wall 21. Inside the outlet chamber 12 a device 23 is fixedly attached to this end wall to bring during operation at least a portion of the liquid, which is present in the outlet chamber, to rotate at a lower angular speed than the rotor. An annular zone 24 of the outlet chamber 12 surrounding the rotational axis coaxially, in which the inlet opening of the outlet channels is located, is so big and free from elements rotating with the rotor that liquid in this zone is admitted to flow at an essential lower angular speed than the rotor.

On the other end wall 22 elements 25 are fixedly attached to the rotor to form passages 26, through which liquid in the outlet chamber flows when the free liquid surface is located radially inside a predetermined radial level 27. For this purpose the passages have inlets, which are located at the predetermined radial level 27, and outlets, which are located radially outside this radial level 27.

Figure 2:
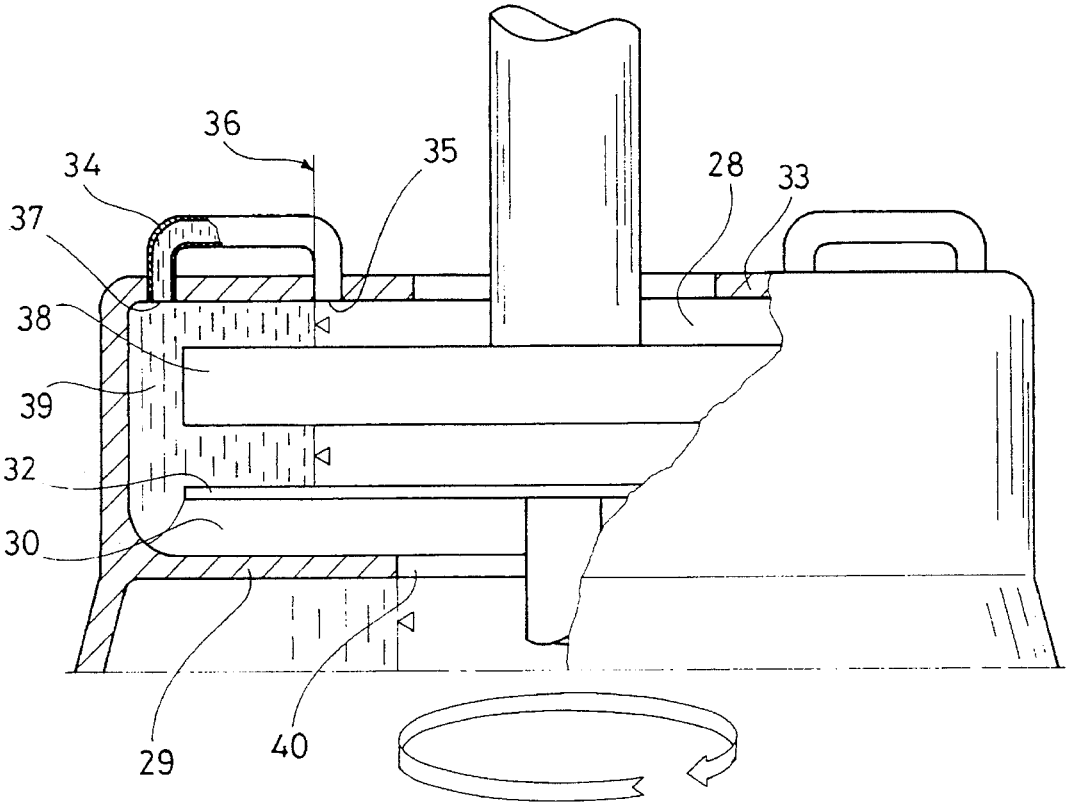

In FIG. 2 an outlet chamber 28 in a centrifugal separator according to an embodiment of the invention is shown in more detail. The device shown in this figure consist of wall elements 30 fixedly attached to the one end wall 29, the wall elements extending radially, axially, and in circumferential direction and between themselves forming channels 31. On the side of the wall elements 30 turned from the end wall 29 an annular covering device 32 surrounding the rotational axis are fixedly attached, which delimit the channels 31 axially from the outlet chamber 28. To the other end wall 33 elements 34 are fixedly attached, which form passages having an inlet 35 located at the predetermined radial level 36 and having outlets 37 located radially outside this level.

The circular disc shaped discharge device 38 arranged in the outlet chamber 28 is in its radial outer portion surrounded by an annular zone 39 of the outlet chamber 28 surrounding the rotational axis, which is free from elements rotating with the rotor and is so big that liquid, which is located during operation in this zone 39 of the outlet chamber 28, is admitted to rotate at a lower angular speed than the rotor.

Figure 3:
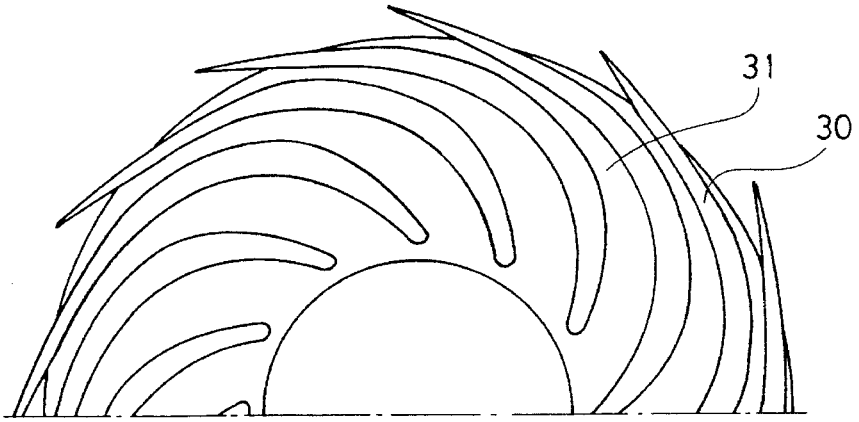

In FIG. 3 there is shown a view from above of the wall elements 30 and the channels 31 in FIG. 2. The channels 31 are in the shown example converging radially outwardly and are delimited forwardly seen in the rotational direction by a surface, which extends radially between the opening into the outlet chamber 28 of the connection 40 and the free liquid surface and is curved in a plane perpendicular to the rotational axis with a centre of curvature, which for each point on the surface is located behind the surface seen in the rotational direction, and with a radius of curvature, which for essentially each point on the surface is smaller than the radius of curvature of an involute, along which separated liquid strives to move freely radially outwardly relative to the rotor, at the same radius, as the radius at which the point is located.

Figure 4:
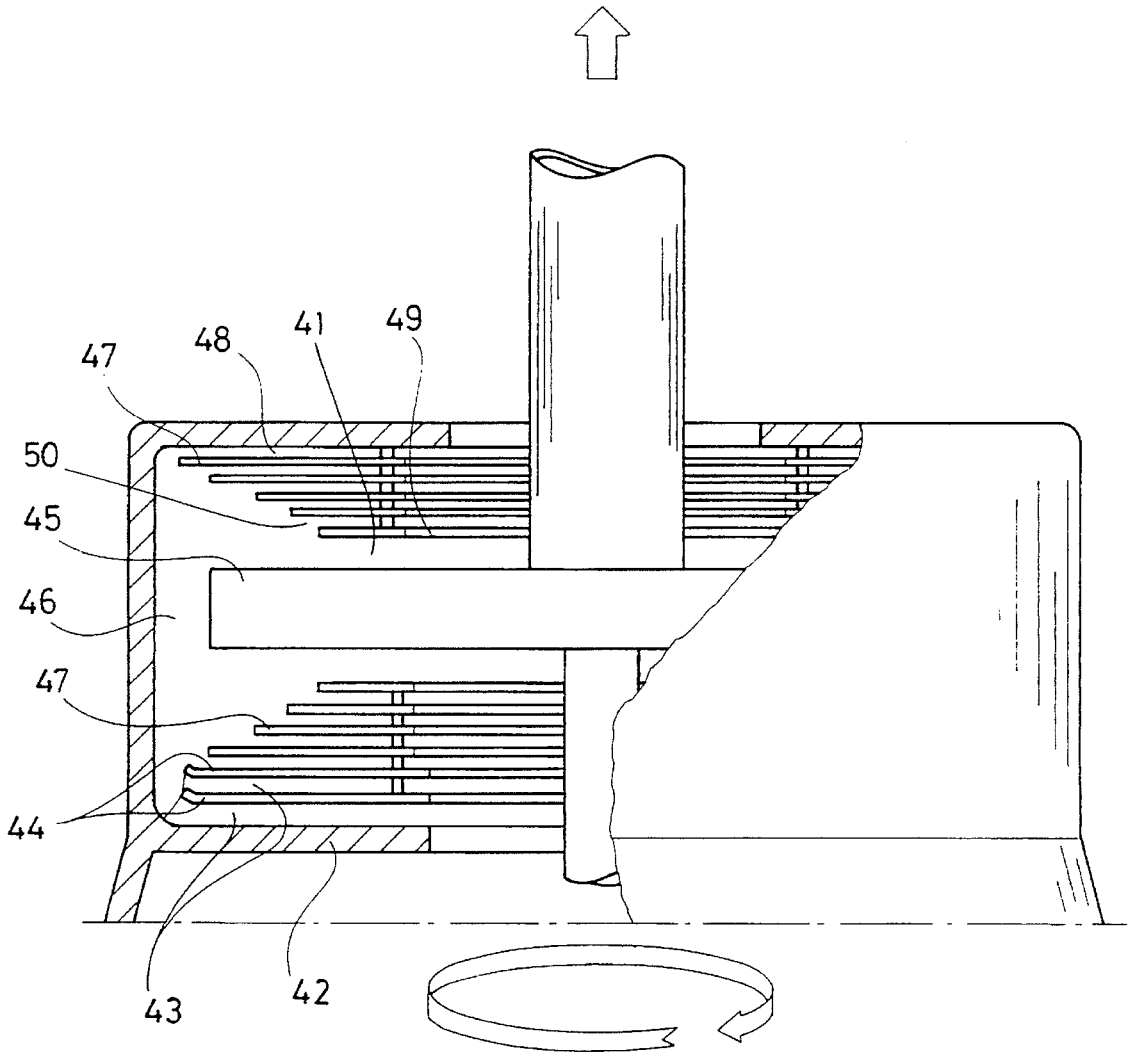

In FIG. 4 an outlet chamber 41 in a centrifugal separator according to another embodiment of the invention is shown. According to this embodiment said device partly consists of wall elements 43 fixedly attached to the end wall 42, which are of the same kind as the wall elements 30 shown in FIG. 3, and to which a covering device 44 is fixedly attached covering the channels (not shown) between the wall elements 43. To the axially opposite side of the covering device 44 other wall elements 43 are fixedly attached, which between themselves form other channels (not shown), which in turn are covered by a covering device 44.

Centrally in the outlet chamber 41 a circular disc shaped discharge device 45 is arranged also in this embodiment, which in its radially outer part is surrounded by an annular zone 46 of the outlet chamber 41 surrounding the rotational axis, which is free from elements rotating with the rotor and is so big that liquid, which is located during operation in this zone 46 of the outlet chamber, is admitted to rotate at a lower angular speed than the rotor.

On each axial sides of the discharge device 45 elements rotating with the rotor are arranged in the outer chamber 41 in the shape of a number of annular circular disc 47, which delimit passages 48 for the liquid, which is located during operation in the outlet chamber 41. Centrally each disc has a circular opening, the center of which coincides with the rotational axis. The largest radii of the openings are equally big and form inlets 49 to the passages 48 at a predetermined radial level. The outlet 50 of the passages 48 are in this shown example located at a radius, which increases with the distance from the discharge device 45.

Upon start of the centrifugal separator the rotor is brought to rotate and the separation chamber 5 is closed by supplying a closing liquid to the closing chamber 7 through the inlet 8. When the separation chamber 5 is closed the liquid, which is to be centrifugally treated, can be supplied to the separation chamber through the inlet tube 15 and the inlet chamber 16. Eventually the separation chamber 5 is filled up, the rotor obtains operational number of revolutions and the conditions are stabilized inside the separation chamber. The components in the supplied liquid are separated during the influence of the centrifugal forces acting on the same.

The separation is then mainly taking place in the spaces between the conical discs in the disc stack 10. During the separation the specific heavier component is thrown radially outwardly and is collected at the radially outermost part of the separation chamber, whereas a specific lighter liquid flows radially inwardly in these spaces.

The specific heavier component is discharged intermittently during operation by having the valve slide 4 to uncover the peripheral outlet openings 6 during time periods.

The specific lighter liquid flows out of the separation chamber 5 through passages 13 to the outlet chamber 12, in which it forms a rotating liquid body with a radially inwardly directed free liquid surface. The liquid present in the outlet chamber 12 is discharged through the outlet 19 and further out through the outlet channel 20 in the stationary outlet device 18.

At least a portion of the liquid present in the outlet chamber, or as shown in the embodiment according to FIG. 2, 3 and 4 the liquid flowing into the outlet chamber 28 and 41, respectively, is brought to rotate at a lower rotational speed than the rotor.

According to the embodiments shown in FIG. 2, 3 and 4 this is taking place by the fact that the liquid entered the outlet chamber is brought during its radial movement radially outwardly towards the free liquid surface to flow in channels, which seen forwardly in the rotational direction is delimited by a surface of the wall element 30 and 43, respectively. This surface is curved in a plane perpendicular to the rotational axis with a central curvature, which for essentially each point on this portion of the surface is located behind the surface seen in the rotational direction and with a radius of curvature, which for each point on this portion of the surface is smaller than the radius of curvature of an involute, along which separated liquid strives to move freely radially outwardly relative to the rotor, at the same radius, as the radius at which the point is located.

Thanks to this design the liquid will flow radially outwardly along this surface. The kinetic energy possessed by the liquid when it enters the outlet chamber will hereby be reused at least partly to operate the rotor.

Within the range of the present invention it is quite possible to bring liquid present in the outlet chamber to rotate at a lower angular speed than the rotor in another way. For instance, the liquid can by different design of channels in the separation chamber be given a lower angular speed already before it enters the outlet chamber. Besides, the liquid flow into the outlet chamber can be directed in a way such that its angular speed becomes lower than the rotor. Another alternative is to recirculate a portion of the liquid, which has been discharged by the stationary discharge device, to the outlet chamber.

What is claimed is:

1. A method of regulating during operation the outlet flow of a liquid separated in a separation chamber in a rotor of a centrifugal separator, the rotor being rotatable around a rotational axis in a predetermined rotational direction, in which method the separated liquid is conducted into an outlet chamber and is brought to form a rotating liquid body in the outlet chamber with a radially inwardly directed free liquid surface and is discharged out of the outlet chamber through a stationary discharge device, which has at least one internal outlet channel with an inlet opening in a radial outer part of the discharge device, said radial outer part during operation is located radially outside the free liquid surface, wherein the separated liquid is charged through the outlet channel with an outlet flow, which is regulated by bringing at least a portion of the separated liquid present in the outlet chamber to rotate at a lower angular speed than the rotor in an annular zone of the outlet chamber, which coaxially surrounds the rotational axis and is free from elements rotating with the rotor, and in which the inlet opening is located, and by bringing liquid present in this zone to flow through at least one passage, which is delimited by elements rotating with the rotor, said at least one passage having an inlet and having an outlet located radially outside this inlet in the outlet chamber, when the free liquid surface is located radially inside a predetermined radial level, at which the inlet of the at least one passage is located.

2. The method according to claim 1, wherein the separated liquid is conducted into the outlet chamber radially inside the free liquid surface and in that the liquid entered into the outlet chamber is brought to flow radially outwardly towards the free liquid surface through channels along and in contact with a surface of a wall element in the outlet chamber, the surface delimiting each channel forwardly seen in the rotational direction and extending radially, axially and in the circumferential direction and being curved in a plane perpendicular to the rotational axis with a center of curvature, which at each point on the surface is located behind the surface seen in the rotational direction, and has a radius of curvature, which at essentially each point on the surface is smaller than the radius of curvature of an involute, along which separated liquid freely strives to move radially outwardly relative to the rotor at the radius, at which said point is located.

3. A centrifugal separator to carry out the method according to claim 1, comprising a rotor, which is rotatable around a rotational axis in a predetermined direction and forms an inlet chamber for a liquid to be centrifugally treated, a separation chamber, which is connected to the inlet chamber, an outlet chamber, which is delimited axially by two end walls and radially by a circumferential wall connecting these end walls and is arranged to receive during operation a liquid separated in the separation chamber, the outlet chamber being so designed that liquid present in the outlet chamber forms a rotating liquid body having a radially inwardly directed free liquid surface, and a connection, which is arranged through one of said end walls and has an opening in the outlet chamber located radially inside the radial level of the free liquid surface, and through which connection the outlet chamber communicates with the separation chamber, the centrifugal separator also comprising a stationary discharge device, which is arranged in the outlet chamber and has at least one outlet channel connected to an outlet, the outlet channel having an inlet opening in a part of the discharge device, which is located radially outside the free liquid surface, wherein the inlet opening is located in an annular zone of the outlet chamber, which surrounds the rotational axis and is so big and free from elements rotating with the rotor that liquid is admitted to rotate at an essentially lower angular speed than the rotor, a device is connected to the outlet chamber to bring at least a portion of the liquid, which is present in this zone of the outlet chamber, during operation to rotate at a lower angular speed than the rotor, and elements rotating with the rotor are arranged to form at least one passage, which has an inlet located in the outlet chamber at a predetermined radial level radially inside the inlet opening of the outlet channel and an outlet located radially outside this radial level in a way such that separated liquid is admitted to flow through this passage radially outwardly during entertainment of the separated liquid into the rotation of the rotor when said liquid surface is located radially inside the inlet of the passage.

4. The centrifugal separator according to claim 3, which further comprises at least two wall elements, which are arranged in the outlet chamber fixedly connected to said one end wall and extend radially, axially and in the circumferential direction, and are arranged to form a channel between themselves for the flow of separated liquid, which enters the outlet chamber via said connection, radially outwardly towards the free liquid surface, the channel being delimited forwardly seen in the rotational direction by a surface of one of the wall elements, at least a part of the surface extending radially between the opening of the connection into the outlet chamber and the free liquid surface, said wall element surface being curved in a plane perpendicular to the rotational axis with a center of curvature, which at essentially each point on this part of the surface is located behind the surface seen in the rotational direction, and with a radius of curvature, which at each point on this part of the surface is smaller than a radius of curvature of an involute, along which separated liquid strives to move freely radially outwardly relative to the rotor, at the same radius as the radius at which the point is located.

5. The centrifugal separator according to claim 4, further comprising a covering device, which is arranged in the outlet chamber fixedly connected to each one of the wall elements on their axial sides turned from said one end wall and is arranged to delimit at least a portion of the channel located closest to the connection from the outlet chamber.

6. The centrifugal separator according to claim 3, wherein said elements form at least two passages, each having an inlet, each of which inlets is located at the predetermined radial level.

7. The centrifugal separator according to claim 6, wherein the outlets of the passages are located at different radial levels.

8. The centrifugal separator according to claim 3, wherein said elements comprise at least one annular disc extending around the rotational axis having an opening extending radially outwardly to the predetermined radial level.

9. The centrifugal separator according to claim 8, wherein the opening is circular and enclosing the rotational axis concentrically.

* * * * *

UNITED STATES PATENT AND TRADEMARK OFFICE

CERTIFICATE OF CORRECTION

PATENT NO. : 5,599,271

DATED : February 4, 1997

INVENTOR(S) : Jon Eiken

It is certified that error appears in the above-identified patent and that said Letters Patent is hereby corrected as shown below:

Title page, Section [86], both occurrences of "Feb. 20, 1995" should be --Feb. 20, 1996--.

Signed and Sealed this

Twentieth Day of October, 1998

Bruce Lehman

*Attest:*

BRUCE LEHMAN

*Attesting Officer*

*Commissioner of Patents and Trademarks*